US008951095B2

(12) United States Patent
Lujan et al.

(10) Patent No.: US 8,951,095 B2
(45) **Date of Patent: *Feb. 10, 2015**

(54) HIGH SELECTIVITY SLURRY DELIVERY SYSTEM

(75) Inventors: Randall Lujan, Round Rock, TX (US); Ahmed Ali, Cedar Park, TX (US); Michelle Garel, Austin, TX (US); Josh Tucker, Austin, TX (US)

(73) Assignees: Samsung Austin Semiconductor, L.P., Austin, TX (US); Samsung Electronics Co., Ltd., Yongin (KR)

( * ) Notice: Subject to any disclaimer, the term of this patent is extended or adjusted under 35 U.S.C. 154(b) by 1705 days.

This patent is subject to a terminal disclaimer.

(21) Appl. No.: 11/115,065

(22) Filed: Apr. 25, 2005

(65) Prior Publication Data

US 2005/0250419 A1 Nov. 10, 2005

Related U.S. Application Data

(63) Continuation of application No. 10/302,794, filed on Nov. 22, 2002, now Pat. No. 6,884,145.

(51) Int. Cl.
*B24B 57/02* (2006.01)

(52) U.S. Cl.
USPC ..... 451/5; 451/8; 451/36; 451/41; 451/60; 451/287; 451/446; 438/692; 156/345.13; 156/345.18

(58) Field of Classification Search
USPC ..... 451/5, 8, 9, 10, 11, 36, 41, 60, 446, 451/285, 287, 288; 438/692, 693; 156/345.12, 345.13, 345.15, 345.18
See application file for complete search history.

(56) References Cited

U.S. PATENT DOCUMENTS

| | | | | |
|---|---|---|---|---|
| 4,369,031 | A | 1/1983 | Goldman et al. | |
| 5,365,962 | A | 11/1994 | Taylor | |
| 5,478,435 | A * | 12/1995 | Murphy et al. | 438/693 |
| 5,710,069 | A | 1/1998 | Farkas et al. | |
| 5,836,066 | A | 11/1998 | Ingram | |
| 5,846,398 | A | 12/1998 | Carpio | |
| 5,921,849 | A | 7/1999 | Kim et al. | |
| 6,015,333 | A | 1/2000 | Obeng | |
| 6,048,256 | A | 4/2000 | Obeng et al. | |
| 6,059,920 | A * | 5/2000 | Nojo et al. | 156/345.12 |

(Continued)

FOREIGN PATENT DOCUMENTS

JP 01312423 4/2005

OTHER PUBLICATIONS

Stanley Wolf and Richard N. Tauber, "Silicon Processing for the VLSI Era", vol. 2: Process Integration, 1990; pp. 238-239.

(Continued)

*Primary Examiner* — Eileen P. Morgan

(57) ABSTRACT

Various embodiments of a semiconductor processing fluid delivery system and a method delivering a semiconductor processing fluid are provided. In aspect, a system for delivering a liquid for performing a process is provided that includes a first flow controller that has a first fluid input coupled to a first source of fluid and a second flow controller that has a second fluid input coupled to a second source of fluid. A controller is provided for generating an output signal to and thereby controlling discharges from the first and second flow controllers. A variable resistor is coupled between an output of the controller and an input of the second flow controller whereby the output signal of the controller and the resistance of the variable resistor may be selected to selectively control discharge of fluid from the first and second flow controllers.

20 Claims, 2 Drawing Sheets

(56) References Cited

U.S. PATENT DOCUMENTS

| | | | | |
|---|---|---|---|---|
| 6,077,437 | A | 6/2000 | Hayashi et al. | |
| 6,099,393 | A | 8/2000 | Katagiri et al. | |
| 6,179,699 | B1 | 1/2001 | Costa | |
| 6,514,863 | B1 * | 2/2003 | He | 438/692 |
| 6,655,408 | B2 | 12/2003 | Linthorst | |
| 6,722,943 | B2 * | 4/2004 | Joslyn | 451/5 |
| 6,749,735 | B1 | 6/2004 | Le Febre | |
| 6,790,127 | B2 * | 9/2004 | Tanoue et al. | 451/41 |
| 6,874,929 | B2 * | 4/2005 | Hiraoka | 366/152.6 |
| 6,910,954 | B2 * | 6/2005 | Kim et al. | 451/60 |
| 7,465,358 | B2 * | 12/2008 | Weidman et al. | 118/667 |
| 7,520,285 | B2 * | 4/2009 | Garcia | 134/98.1 |

OTHER PUBLICATIONS

Particle Sizing Systems, Brochure for AccuSizer 780/OL Online Particle Size Analyzer, 1999, pp. All.

Shape Memory Applications, Inc., NiTi Smart Sheet No. 4-Two-Way Memory, http://www.sma-inc.com/two-way.html, Mar. 25, 1998, pp. 1-2.

Shape Memory Applications, Inc., NiTi Smart Sheet No. 8-NiTi Actuator Wire Properties, http://www.sma-inc.com/Actuators.html, Mar. 25, 1998, pp. 1-2.

Shape Memory Applications, Inc., NiTi Smart Sheet No. 3-Selected Properties of NiTi, http://www.sma-inc.com/NiTiProperties.html, Mar. 25, 1998, pp. 1-2.

Shape Memory Applications, Inc., NiTi Smart Sheet No. 13-Specifiying NiTi Materials, http:www.sma-inc.com/SpecifyingNiTi.htmi, May 1, 1998, pp. 1-6.

Dynalloy, Inc., Flexinol™; http:www.dynalloycom/in-tro.html, Dec. 1998, pp. 1-2.

NT International, Model 6500 Integrated Flow Controller, http://www.nt-intl.com/products__uhp__fc__6500.asp, 2002, pp. all.

* cited by examiner

HIGH SELECTIVITY SLURRY DELIVERY SYSTEM

This application is a continuation of prior U.S. patent application Ser. No. 10/302,794 filed on Nov. 22, 2002 now U.S. Pat. No. 6,884,145.

BACKGROUND OF THE INVENTION

1. Field of the Invention

This invention relates generally to semiconductor processing, and more particularly to semiconductor processing fluid delivery systems and to method of delivering semiconductor processing fluids.

2. Description of the Related Art

Conventional chemical mechanical planarization ("CMP") processes involve the planarization of a surface of a wafer or workpiece through the use of an abrasive slurry and various rinses and solvents. Material removal from the workpiece surface is through a combination of abrasive action and chemical reaction. In many processes, a quantity of abrasive slurry is introduced onto a polish pad or platen of the CMP tool and distributed across the surface thereof by means of centrifugal force. Thereafter, one or more wafers are brought into sliding contact with the polish pad for a select period of time.

In many conventional CMP systems, processing fluids such as slurries, solvents and rinses are dispensed from a static dispense tube that is centrally positioned above the polish pad. The polish pad is fitted with an upwardly projecting dispersal cone that is designed to disperse processing fluid dispensed from above laterally across the polishing surface of the polish pad. The action of the fluid flowing down the sloped surfaces of the dispersal cone along with centrifugal force associated with the rotation of the polish pad is intended to provide a fairly uniform layer of processing fluid across the surface of the polish pad.

A more recent innovation involves the use of so-called high selectivity slurry. Conventional high selectivity slurry mixtures contain a slurry additive that functions in the conventional sense. However, a slurry additive is mixed with the slurry to provide a selectivity of polish of an overlying film relative to an underlying film. A common application involves CMP of an overlying silicon dioxide film selectively to an underlying silicon nitride film. The slurry additive slows the chemical activity of the slurry when the polish exposes the underlying silicon nitride. It is desirable, though not currently possible, to maintain precise control over the flow rates of the slurry and the slurry additive. Deviations in the flow rate of either component can lead to poor selectivity and film non-uniformity.

One conventional means of delivering CMP slurry to a platen involves the use of peristaltic pumps. A peristaltic pump, as the name implies, utilizes peristaltic or squeezing action to squeeze a pliable container, usually a plastic tube, in order to pump the working fluid. One difficulty associated with the peristaltic pumping is a propensity for the pump's actual flow rate to deviate significantly from the desired flow rate. The reasons for such deviations are legion, and include variations in the elasticity of the compliant tubing, non-uniformity in the composition of the slurry, and air trapped in the line to name just a few.

The delivery of high selectivity slurry introduces another set of complexities. As noted above, the ratio of flow rates of the slurry and the slurry additive in a high selectivity slurry context should be carefully controlled in order to achieve the desired selectivity of CMP activity. However, if peristaltic pumping is used for both the slurry additive and the slurry, then deviations can arise in the flow ratios and thus non-uniformity in CMP processing may result.

Various conventional retrofit designs for high selectivity slurry delivery have been developed. These conventional retro fit systems are generally designed to retrofit into an existing CMP tool and take over some of the functionality of working fluid delivery to the platen. A disadvantage associated with these conventional high selectivity slurry retrofit systems is sometimes poor control of the flow rates of each of the constituents, that is, the slurry and the slurry additive, and an inability to provide a mixing of the slurry and the slurry additive prior to delivery to the platen.

The present invention is directed to overcoming or reducing the effects of one or more of the foregoing disadvantages.

SUMMARY OF THE INVENTION

In accordance with one aspect of the present invention, a system for delivering a liquid for performing a process is provided. The system includes a first flow controller that has a first fluid input coupled to a first source of fluid and a second flow controller that has a second fluid input coupled to a second source of fluid. A controller is provided for generating an output signal to and thereby controlling discharges from the first and second flow controllers. A variable resistor is coupled between an output of the controller and an input of the second flow controller whereby the output signal of the controller and the resistance of the variable resistor may be selected to selectively control discharge of fluid from the first and second flow controllers.

In accordance with another aspect of the present invention, a slurry delivery system is provided. A first flow controller is provided that has a first fluid input coupled to a source of slurry additive. The slurry additive enables chemical mechanical polishing of a film selectively to another film. A second flow controller is provided that has a second fluid input coupled to a source of slurry. A controller is included for generating an output signal to and thereby controlling discharges from the first and second flow controllers. A variable resistor is coupled between an output of the controller and an input of the second flow controller whereby the output signal of the controller and the resistance of the variable resistor may be selected to selectively control discharge of slurry additive from the first flow controller and slurry from the second flow controller.

In accordance with another aspect of the present invention, a chemical mechanical polishing system is provided that includes a platen for engaging a semiconductor workpiece and a first flow controller that has a first fluid input coupled to a source of slurry additive. The slurry additive enables chemical mechanical polishing of a film of the semiconductor workpiece selectively to another film of the semiconductor workpiece. A second flow controller is provided that has a second fluid input coupled to a source of slurry. A manifold is coupled to respective fluid outputs of the first and second flow controllers and has an output for delivering discharges from the first and second flow controllers to the platen. A controller is included for generating an output signal to and thereby controlling discharges from the first and second flow controllers to the platen. A variable resistor is coupled between an output of the controller and an input of the second flow controller. The output signal of the controller and the resistance of the variable resistor may be selected to selectively control discharge of slurry additive from the first flow controllers and slurry from the second flow controller to the platen.

In accordance with another aspect of the present invention, a method of delivering a liquid for performing a process is provided that includes delivering a first fluid to a first flow controller and a second fluid to a second flow controller. An output signal to the first and second flow controllers is generated to control respective discharges therefrom. A portion of the output signal is passed through a variable resistor coupled between an output of the controller and an input of the second flow controller. The output signal may be selected to selectively control discharge of the first fluid from the first flow controller and the resistance of the variable resistor may be selected selectively control discharge of the second fluid from the second flow controller.

BRIEF DESCRIPTION OF THE DRAWINGS

The foregoing and other advantages of the invention will become apparent upon reading the following detailed description and upon reference to the drawings in which.

DETAILED DESCRIPTION OF SPECIFIC EMBODIMENTS

Figure 1:
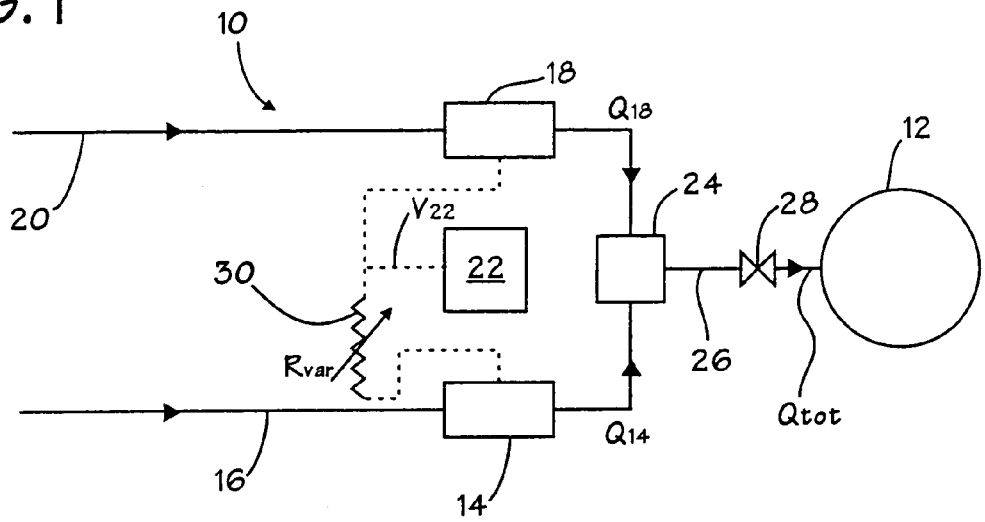
FIG. 1 is a schematic view of an exemplary embodiment of a semiconductor processing fluid delivery system in accordance with the present invention.

In the drawings described below, reference numerals are generally repeated where identical elements appear in more than one figure. Turning now to the drawings, and in particular to FIG. 1, therein is shown a schematic view of an exemplary embodiment of a semiconductor processing fluid delivery system 10 (hereinafter "system 10") that is suitable for delivering a preselected flow rate or discharge of a working fluid to a semiconductor processing tool 12. The tool 12 may be a chemical mechanical polishing tool or other semiconductor processing tool that may benefit from the control delivery of a liquid. In the illustrated embodiment, the tool 12 consists of a CMP tool that includes at least one platen for engaging a semiconductor workpiece during CMP. A programmable flow controller 14 receives a fluid input from input lines 16 and another programmable flow controller 18 receives a fluid input from an input line 20. The input line 16 may deliver, for example, CMP slurry, deionized water, or a combination of the two or other liquids as desired. The input line 20 may be provided to deliver a flow of a slurry additive such as, for example, additives to provide a high selectivity slurry for use in the tool 12.

The programmable flow controllers 14 and 18 are advantageously electronically controlled flow control devices that receive control inputs from a system controller 22. The flow controllers 14 and 18 may be programmed to discharge fluid at specific rates in response to particular signal voltage inputs. The discharge rates typically vary from zero up to some maximum discharge. The particular implementation of the flow controllers 14 and 18 is a matter of design discretion. Some variations include a valve and a flow sensor. Feedback is applied to the setting of the valve to maintain a desired flow rate. In an exemplary embodiment, the flow controllers 14 and 18 may be model NT 6500 integrated flow controllers manufactured by NT International.

The discharges of the flow controllers 14 and 18 flow to the tool 12. An optional manifold 24 may be provided at the outputs of the flow controllers 14 and 18, which serves the customary function of a manifold in that the flows from each of the controllers 14 and 18 are mixed therein and discharged to an outlet line 26. The manifold is advantageously composed of corrosion resistant material. If the fluids delivered by one or both of the flow controllers 14 and 18 are chemically reactive, then the manifold is advantageously composed of or at least lined internally with a chemically inert material, such as Teflon. A valve 28 may be provided to prevent or enable flow of the liquid to the tool 12 as desired. The valve 28 may be manually operated, fluid operated, or electrically operated as desired.

The system controller 22 may be implemented in a myriad of ways, such as, for example, as a microprocessor, a logic array, a gate array, an application-specific integrated circuit, software executable on a general purpose processor computer, combinations of these or the like. The system controller 22 may be dedicated to the control of the flow controllers 14 and 18 and valving of the system 10 alone or may be further provided with capability to also control the processing tool 12 as desired. For example, if the processing tool 12 is a CMP tool, such as an Applied Materials Mirra model, the system controller 22 may consist of the on-board controller for the Mirra device. If implemented as a Mirra system, the system controller 22 is operable to output a DC signal that may be varied between 0 and 10 volts.

The dashed lines between the system controller 22 and the flow controllers 14 and 18 represent the control interfaces between those components. The interfaces are preferably hard-wired connections, but may be wireless if desired. If wireless, then appropriate receivers will have to be used to ensure that the requisite voltage inputs are supplied to the flow controllers 14 and 18.

It is desirable to include a variable resistor 30 between the output of the controller 22 and input of the flow controller 14. The purpose of the variable resistor 30 is to enable the operator to vary the voltage signal delivered to the flow controller 14 and thereby select the ratio of the discharges of the flow controller 14 and the flow controller 18. In this way, the operator may select different concentration ratios between the liquid delivered from the flow controller 14 and the flow controller 18 in order to implement a desired functionality in the processing tool 12. The flow controllers 14 are calibrated to provide a flow rate that is proportional to the input voltage from the system controller 22. If commercially produced, the flow controllers 14 and 18 will normally be factory calibrated. However, manual calibration may be performed as desired. In either case, the goal is to have on hand a look-up table of flow rate or discharge as a function of input signal voltage from the system controller 22. Exemplary look-up tables for the flow controllers 14 and 18 appropriate for model NT6500 flow controllers are set forth in Tables 1 and 2 below:

TABLE 1

LOOK-UP TABLE FOR FLOW CONTROLLER 14

| Flow Rate (ml/min) | Required Input DC Voltage (volts) |
|---|---|
| 13.82 | 0.68 |
| 27.63 | 1.35 |
| 41.45 | 2.03 |
| 55.26 | 2.71 |
| 69.08 | 3.38 |
| 78.75 | 3.15 |

TABLE 1-continued

| LOOK-UP TABLE FOR FLOW CONTROLLER 14 | |
|---|---|
| Flow Rate (ml/min) | Required Input DC Voltage (volts) |
| 82.89 | 3.67 |
| 96.71 | 4.74 |
| 110.53 | 5.41 |
| 124.34 | 6.09 |
| 138.16 | 6.76 |

TABLE 2

| LOOK-UP TABLE FOR FLOW CONTROLLER 18 | |
|---|---|
| Flow Rate (ml/min) | Required Input DC Voltage (volts) |
| 12.50 | 1 |
| 25.00 | 2 |
| 37.50 | 3 |
| 50.00 | 4 |
| 62.50 | 5 |
| 71.26 | 5.7 |
| 75.00 | 6 |
| 87.50 | 7 |
| 100.00 | 8 |
| 112.50 | 9 |
| 125.00 | 10 |

With the calibration of the flow controllers 14 and 18 in hand, the discharge $Q_{18}$ of the flow controller 18 may be set by adjusting the output voltage of the system controller 22 to a selected level and then the variable resistor 30 may be adjusted accordingly to drop down the voltage input to the flow controller 14 and thereby achieve a desired discharge $Q_{14}$. In this way, both a desired total discharge $Q_{tot}$ to the tool 12 and desired individual discharges $Q_{18}$ and $Q_{14}$ that make up the total discharge $Q_{tot}$ may be achieved. It is convenient to specify in the first instance the desired individual discharges in terms of a percentage of the total discharge $Q_{tot}$ Thus, the percentage of total discharge $Q_{tot}$ attributable to the flow controller 18 % $Q_{18}$ is given by:

$$\%Q_{18} = \frac{Q_{tot} - Q_{14}}{Q_{tot}} \times 100 \qquad \text{Equation 1}$$

and the percentage of the total discharge attributable to the flow controller 14 % $Q_{14}$ is given by:

$$\%\,Q_{14} = 100 - \%\,Q_{18} \qquad \text{Equation 2}$$

The selection of an output voltage $V_{22}$ from the system controller 22 and a resistance $R_{var}$ for the variable resistor 30 in order to achieve a desired total liquid discharge $Q_{tot}$ and desired individual discharges $Q_{14}$ and $Q_{18}$ from the flow controllers 14 and 18 will now be described. Assume that there is a demand from the tool 12 for a total discharge $Q_{tot}$ of about 150 ml/min of liquid. Assume further that the desired percentage % $Q_{18}$ of the total discharge $Q_{tot}$ attributable to the flow controller 18 is 47.5%. The value of % $Q_{18}$ may be selected according to a manufacturer's recommendation for the particular process and composition of the liquid, e.g., CMP and a high selectivity slurry additive, or some other process criteria, or by first specifying a desired % $Q_{14}$ and using Equation 1 above. Using a % $Q_{18}$ of 47.5% and Equation 2 above yields a % $Q_{14}$ of 52.5%. The desired discharge $Q_{18}$ from the flow controller 18 is given by applying the % $Q_{18}$ of 47.5% to the selected $Q_{tot}$ of about 150 ml/min to yield a $Q_{18}$ of 71.26 ml/min. In order to deliver the requisite 71.26 ml/min from the flow controller 18, the system controller 22 issues an appropriate output voltage signal. From the look-up table, Table 2 above, a $Q_{18}$ of 71.26 ml/min corresponds to a 5.7 volt output signal. The requisite $Q_{14}$ to produce the $Q_{tot}$ of about 150 ml/min is 78.75 ml/min, i.e., $Q_{tot}$–$Q_{18}$.

The selection of an appropriate value for $R_{var}$ to achieve a $Q_{14}$ is a multi-step procedure. First, the requisite discharge $Q_{14}$ of 78.75 ml/min from the flow controller 14 is used in conjunction with the Table 1 above to determine the corresponding input voltage signal to the flow controller 14. This turns out to be 3.15 volts. Since the input voltage to the variable resistor 30 is 5.7 volts, there must be a voltage drop of 2.55 volts across the variable resistor to produce the requisite input voltage of 3.15 volts at the flow controller 14.

With the required voltage drop across the variable resistor 30 computed, the resistance setting for the variable resistor 30 may be determined by dividing by the current through the flow controller 14. The current through the flow controller 14 may be calculated using Ohm's Law, the input voltage to the flow controller 14 of 3.15 volts and the known resistance of the flow controller 14. The resistance of the flow controller 14 may be supplied by the manufacturer or measured as desired. In the illustrated embodiment, the resistance of the NT6500 flow controller 14 is about 20,000 ohms. Dividing the input voltage of 3.15 volts by the known resistance of 20,000 ohms results in a current of 0.000158 amps. This is also the current through the variable resistor. Again using Ohms Law, dividing the 2.55 volt drop by the 0.000158 amp current yields a desired resistance of 16,190.43 ohms for the variable resistor 30.

With the variable resistor 30 set at 16,190.43 ohms and the output of the system controller 22 set at 5.7 volts, a $Q_{18}$ 71.26 ml/min and a $Q_{14}$ of 78.75 ml/min are delivered to the manifold 24 and mixed. The valve 28 is opened either manually or by the system controller 22 and the combined $Q_{tot}$ of 150 ml/min is delivered to the tool 12.

If it is desired to change the flow rates through the flow controllers 14 and 18, then the output signal from the system controller 22 is changed to some new voltage level to establish a flow rate through the flow controller 18 and the resistance of the variable resistor 30 is altered accordingly to establish a desired flow rate through the flow controller 14. In this regard, a useful look-up table may be created that lists controller output voltage $V_{22}$ and resistance $R_{var}$ settings appropriate for various values of $Q_{tot}$, $Q_{14}$ and $Q_{18}$, and preselected values for % $Q_{18}$ and % $Q_{14}$.

TABLE 3

| Preselected % $Q_{18}$ = 47.5% and % $Q_{14}$ = 52.5%. | | | | |
|---|---|---|---|---|
| $Q_{tot}$ (ml/min) | $Q_{18}$ (ml/min) | $Q_{14}$ (ml/min) | $V_{22}$ (volts) | $R_{var}$ (Ohms) |
| 26.32 | 12.50 | 13.82 | 1.0 | 16,190.43 |
| 52.63 | 25.00 | 27.63 | 2.0 | 16,190.43 |
| 78.95 | 37.50 | 41.45 | 3.0 | 16,190.43 |
| 105.26 | 50.00 | 55.26 | 4.0 | 16,190.43 |
| 131.58 | 62.50 | 69.08 | 5.0 | 16,190.43 |
| 150.00 | 71.25 | 78.75 | 5.7 | 16,190.47 |
| 157.89 | 75.00 | 82.89 | 6.0 | 16,190.43 |
| 184.21 | 87.50 | 96.71 | 7.0 | 16,190.43 |
| 210.53 | 100.00 | 110.53 | 8.0 | 16,190.43 |
| 236.84 | 112.50 | 124.34 | 9.0 | 16,190.43 |
| 263.16 | 125.00 | 138.16 | 10.0 | 16,190.43 |

Table 3 is specific to % $Q_{18=47.5}$% and % $Q_{14=52.5}$%. However, once data is gathered for one set of % $Q_{18}$% $Q_{14}$ and $Q_{tot}$ a new table may be determined for different values of % $Q_{18}$% $Q_{14}$ and $Q_{tot}$, by interpolation.

Figure 2:
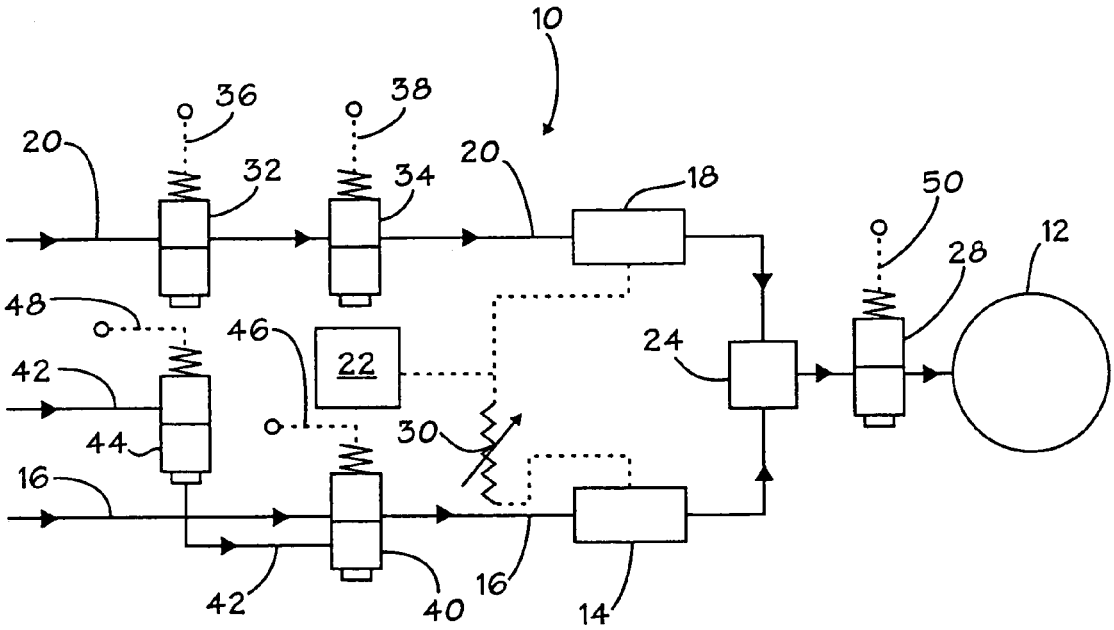
FIG. 2 is another schematic view of an exemplary embodiment of a semiconductor processing fluid delivery system in accordance with the present invention.

A more detailed depiction of an exemplary embodiment of the system 10 is depicted in the schematic view of FIG. 2. The flow controllers 14 and 18, the input lines 16 and 20, the manifold 24 and the variable resistor 30 may be configured and function as generally described elsewhere herein. Additional valving and supply lines are illustrated for this embodiment. In particular, a remotely operable normally open two-way valve 32 and a remotely operable normally closed two-way valve 34 are provided in the fluid supply line 20. The valves 32 and 34 are advantageously remotely operable. The phrase "remotely operable" means that the valves 32 and 34 may be opened and closed by delivering an input to the valve, such as a pneumatic, electrical or hydraulic input. The valves 32 and 34 are operable by means of control lines 36 and 38, which may be pneumatic, hydraulic or electric control lines. The control lines 36 and 38 may interface with the system controller 22 or another control device as desired. The input line 20 is designed to carry a slurry additive, suitable for a high selectivity slurry process.

The input line 16 is designed to carry slurry. The flow of slurry through the input line 16 is controlled by a valve 40, which is advantageously a remotely operable three-way valve. One input to the three-way valve 40 is the supply line 16 and the other input is a supply line 42 that is coupled to an outlet of a remotely operable normally closed two-way valve 44. The supply line 42 is advantageously designed to deliver deionized water for the purpose of flushing the manifold 24 and the tool 12 as necessary. A control line 46 is provided for the valve 40. Similarly, control line 48 is provided for the valve 44.

To deliver slurry and additive to the flow controllers 14 and 18, the normally opened valve 32 is left open, the normally closed valve 34 is opened, the normally closed valve 44 is left closed, and the three-way valve 40 is set to prevent flow from the input line 42 and allow flow from the input line 16. To cut off the flow of additive and slurry, the aforementioned settings for the valves 32 and 34 are reversed and the valve 40 is moved to a position that prevents flow therethrough of fluid from the input line 16.

Depending upon on the chemistry of the fluids, it may be desirable to flush the manifold and the tool 12 with deionized water when process fluids are not delivered. To flush, the valve 32 is closed, the valve 34 is allowed to remain in its normally closed position, the three-way valve 40 is set to enable flow from the line 42 and the valve 44 is opened to enable the flow of deionized water through the line 42. The valve 28 may be a remotely operable normally closed two-way valve controlled by inputs from a control line 50.

Figure 3:
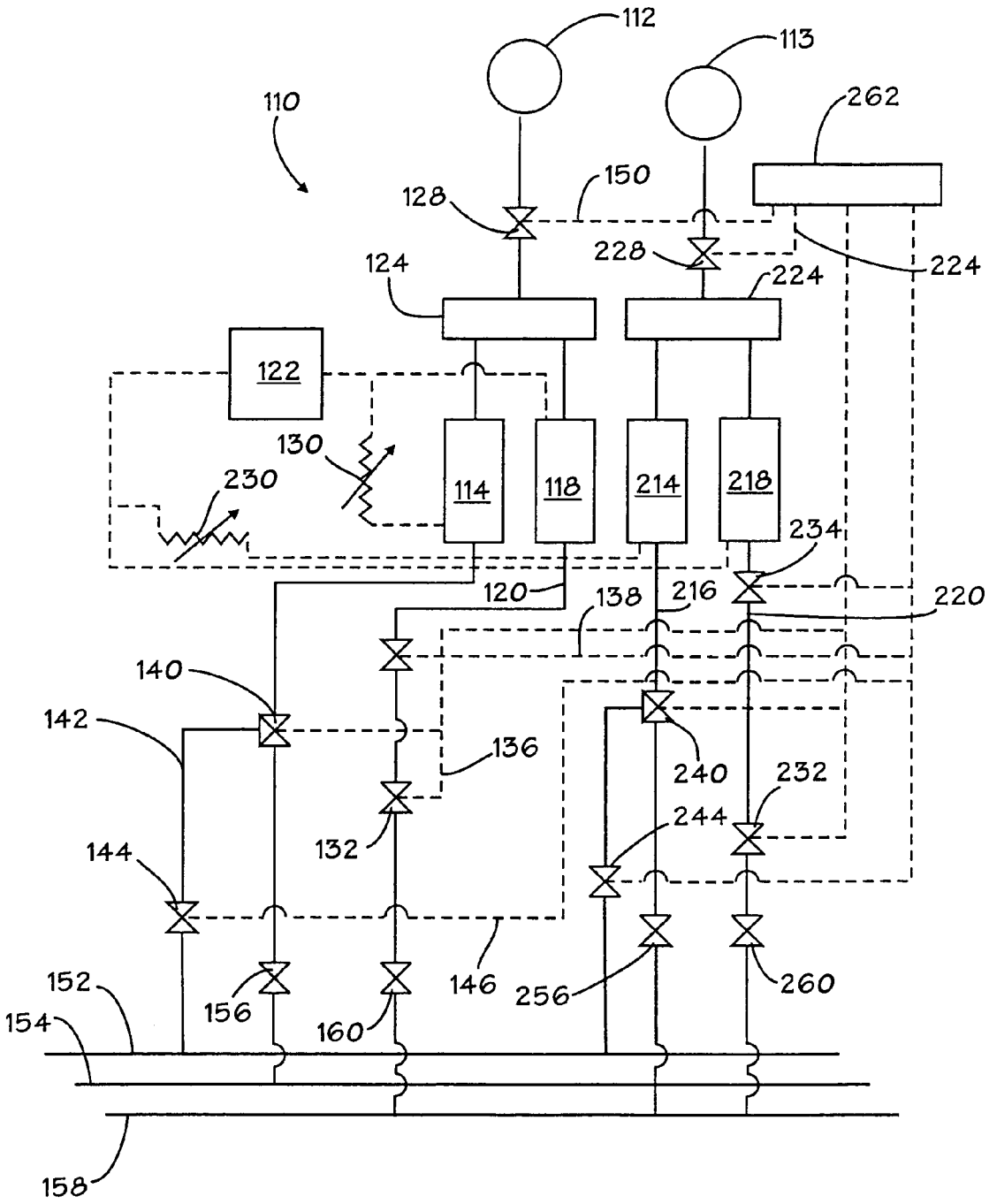
FIG. 3 is another schematic view of an exemplary embodiment of a semiconductor processing fluid delivery system in accordance with the present invention.

An alternate exemplary embodiment of the system 110 may be understood by referring now to FIG. 3, which is a schematic view. In this illustrative embodiment, two tools 112 and 113 are supplied with working fluid. The two tools 112 and 113 may be separate processing tools, or different components of the same processing tool, such as, for example, two different platens on the same CMP tool. The tool 112 is supplied with working fluid by way of two flow controllers 114 and 118, and supply lines 116 and 120. The flow controllers 114 and 118 are controlled by a system controller 122. The outputs of the flow controllers 114 and 118 are coupled to a manifold 124. A valve 128 is provided between the manifold 124 and the tool 112 and may be configured and function like the valve 28 described elsewhere herein. A variable resistor 130 is coupled between an output of the system controller 122 and an input of the flow controller 114 and designed to function as the resistor 30 described in conjunction with FIGS. 1 and 2. The flow controllers 114 and 118, the system controller 122, the valves 132 and 134, their respective control lines 136 and 138, the valve 140 and its supply line 142, and the valve 144 also coupled to the supply line 142 are provided and configured as generally described above in conjunction with the embodiment of FIG. 2, albeit with corresponding element numbers offset by one hundred.

The supply line 142 is connected via the valve 144 to a supply line 152. The supply line 116 is connected to a supply line 154 through the valve 140 and a valve 156 which may be a quarter turn manual valve or other type of valve. The supply line 120 is connected to a supply line 158 via the valves 134 and 132 and a valve 160, which may be like the valve 156.

The tool 113 may be supplied with working fluid by way of flow controllers 214, 218, supply lines 216 and 220, a manifold 224, and valves 232, 234, 240, 244, 256 and 260, which may be configured like the corresponding valves 132, 134, 140, 144, 156 and 160. The valves 132, 140, 232 and 240 are commonly connected to the control line 136 and the valves 234 and 134 are commonly connected to the control line 138. A valve 228, like the valve 128, is provided between the output of the manifold 224 and the tool 113 and serves the same function. A control line 250 is connected to the valve 228. The control lines 150, 136, 138 and 250 are connected to a signal generator 262, which may be a pneumatic, hydraulic, or electrical signal supply system operable to supply input signals to the various controlled valves.

A variable resistor 230 configured as described elsewhere herein is coupled between an output of the system controller 122 and an input of the flow controller 214. The system controller 122, like the system controller 22 depicted in FIGS. 1 and 2, can control some or all of the various components of the system 110.

In operation, the system 110 may supply both the tools 112 and 113 with liquid contemporaneously and at the same flow rates and flow ratios or at different times and at different flow rates and ratios as desired.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents and alternatives falling within the spirit and scope of the invention as defined by the following appended claims.

What is claimed is:

1. A chemical mechanical polishing system, comprising:

a platen adapted to engage a workpiece;

a first source of fluid having a controllable output adapted to deliver a first fluid to the platen;

a second source of fluid having a controllable output adapted to deliver a second fluid to the platen;

a first controller adapted to generate a first signal for controlling the outputs of the first and second sources of fluid;

a modifier adapted to modify the first signal to produce a second signal for the output of the second source of fluid, wherein the second signal is produced substantially concurrently with the first signal, wherein the first controller and the modifier may are adapted to be selectively controlled to determine an amount of the first fluid and an amount of the second fluid delivered to the platen.

2. The system of claim 1, further comprising a combiner adapted to combine the first fluid and second fluid into a combined fluid for delivery to the platen.

3. The system of claim 2, wherein an output of the combiner is adapted to be controlled to determine an amount of combined fluid delivered to the platen.

4. The system of claim 1, wherein the second source of fluid is further adapted to deliver a third fluid to the platen.

5. The system of claim 4, further comprising a second controller adapted to control the outputs of the first and second sources of fluid and control the second source of fluid to deliver a desired one of the second and third fluids, wherein the second controller may selectively control the first and second sources of fluid to deliver only the third fluid to the platen.

6. The system of claim 5, wherein the third fluid is deionized water.

7. The system of claim 1, wherein the first fluid is a slurry additive and the second fluid is a slurry.

8. A slurry delivery system, comprising:

a first flow controller having a first fluid input coupled to a source of slurry additive;

a second flow controller having a second fluid input coupled to a source of slurry;

a first controller adapted to generate a first signal capable of controlling the first flow controller and the second flow controller;

a modifier adapted to modify the first signal to produce a second signal for controlling the second flow controller, wherein the second signal is produced substantially concurrently with the first signal, wherein the first controller and the modifier may be selectively controlled to deteiiiiine an amount of slurry additive delivered by the first flow controller and an amount of slurry delivered by the second flow controller.

9. The system of claim 8, further comprising a combiner adapted to combine the slurry additive delivered by the first flow controller and the slurry delivered by the second flow controller into a combined fluid.

10. The system of claim 9, wherein an output of the combiner is adapted to be controlled to determine an amount of combined fluid delivered by the combiner.

11. The system of claim 8, wherein the second flow controller is further adapted to deliver deionized water.

12. The system of claim 11, further comprising:

a second controller adapted to generate a second signal for controlling the first flow controller and the second flow controller and adapted to control the second flow controller to deliver a desired one of the slurry and the deionized water, wherein the second controller may selectively control the first flow controller and the second flow controller to deliver only the deionized water.

13. A method for use in a chemical mechanical polishing system, the method comprising:

generating a first signal;

in response to the first signal, controlling with a first flow controller delivery of a first fluid to a platen adapted to engage a workpiece;

modifying the first signal to generate a second signal, wherein the second signal is generated substantially concurrently with the first signal;

in response to the second signal, controlling with a second flow controller delivery of a second fluid to the platen; and determining amounts of the first fluid and the second fluid delivered to the platen by selectively controlling the generating of the first signal and the modifying of the second signal.

14. The method of claim 13, further comprising:

combining the first fluid and the second fluid into a combined fluid for delivery to the platen.

15. The method of claim 14, further comprising:

determining an amount of combined fluid delivered to the platen by controlling an output of the combiner.

16. The method of claim 13, further comprising:

controlling delivery of a third fluid to the platen with the second flow controller.

17. The method of claim 16, further comprising:

controlling the first flow controller and the second flow controller to deliver only the third fluid to the platen.

18. The method of claim 17, wherein the third fluid is deionized water.

19. The method of claim 13, wherein the second fluid is a slurry.

20. The method of claim 19, wherein the first fluid is a slurry additive.

* * * * *